United States Patent [19]

Tischer

[11] Patent Number: 4,741,674

[45] Date of Patent: May 3, 1988

[54] MANIFOLD ARRANGEMENT FOR ISOLATING A NON-OPERATING COMPRESSOR

[75] Inventor: James C. Tischer, La Crescent, Minn.

[73] Assignee: American Standard Inc., New York, N.Y.

[21] Appl. No.: 934,361

[22] Filed: Nov. 24, 1986

[51] Int. Cl.[4] ..... F04B 41/06; F04B 49/02

[52] U.S. Cl. ..... 417/295; 417/427

[58] Field of Search ..... 417/53, 426, 427, 295, 417/507; 62/510, 486

[56] References Cited

U.S. PATENT DOCUMENTS

| | | | |
|---|---|---|---|
| 1,948,907 | 2/1934 | Egli | 417/295 |
| 2,178,100 | 5/1937 | Gygax | 417/278 |
| 2,294,552 | 5/1937 | Gygax | 417/278 |
| 3,884,251 | 5/1974 | Knight | 137/615 |
| 4,179,248 | 12/1979 | Shaw | 417/427 |
| 4,586,351 | 5/1986 | Igarashi | 62/510 |

FOREIGN PATENT DOCUMENTS

| | | | |
|---|---|---|---|
| 3201207 | 7/1983 | Fed. Rep. of Germany | 417/295 |

*Primary Examiner*—William L. Freeh

*Attorney, Agent, or Firm*—William J. Beres; David L. Polsley; Robert J. Harter

[57] ABSTRACT

In a system with parallel connected compressors, a suction and discharge manifold arrangement for isolating an inactive compressor from the rest of the operating system. A check valve in the discharge line of the compressor prevents fluid flow back into the discharge port from a common system discharge line when the compressor is de-energized. A normally closed, pressure actuated valve in the suction line of each compressor prevents fluid from flowing through the compressor suction port when the compressor is inactive. The valve is connected to the compressor's discharge line, and opens in response to the discharge pressure developed when the compressor begins to operate. Pressure and oil level equalizing lines interconnect the compressor oil sumps, conveying oil between compressors and equalizing pressure in the oil sumps.

9 Claims, 2 Drawing Sheets

MANIFOLD ARRANGEMENT FOR ISOLATING A NON-OPERATING COMPRESSOR

TECHNICAL FIELD

This invention generally pertains to a system of parallel connected compressors and specifically to a manifold that isolates an inactive compressor from other operating compressors in the system.

BACKGROUND OF THE INVENTION

In most air conditioning applications, the cooling load imposed on the system varies over a relatively wide range as outdoor ambient conditions change. To operate a cooling system efficiently, its capacity should be controlled in direct proportion to changes in the temperature conditioning load. Selectively energizing compressors in an air conditioning system having a plurality of parallel connected compressors is one method of varying system capacity to match the cooling load. This method is typically much less expensive than other alternatives, such as using a variable speed drive for the compressor.

Unfortunately, operation of compressors in parallel is known to create certain problems, particularly when one or more of the compressors is de-energized while other compressors continue to operate. One of the most significant problems is the migration of oil in the system to the oil sump of the compressor having the lowest crankcase pressure. That compressor becomes flooded with oil while the other compressors are starved for adequate lubrication, which in an extreme case, may result in their premature failure.

A further problem can arise in compressors, such as rotary or scroll types, which do not have discharge valves to prevent reverse refrigerant flow through the compressor. When such compressors are de-energized, fluid at discharge pressure may flow back through the de-energized compressor from the system discharge manifold to the system suction manifold, substantially reducing the efficiency of the operating compressors. A check valve in the discharge line of each compressor can prevent back flow of discharge fluid, but does not by itself prevent unequal oil levels in the compressors resulting from unequal sump pressures.

If separate oil sump level and pressure equalizing lines are provided to interconnect the oil sumps of each compressor in a multiple compressor system, a portion of the suction gas flowing through the system's common suction manifold diverts through the suction port of an inactive compressor and then into the operating compressors through the pressure equalizing line, reducing the flow of cooling suction gas through the motors of the operating compressors in the system.

Even a small pressure differential between the oil sumps of parallel connected compressors, caused for example by pressure drop due to fluid flow in a pressure equalizing line may cause oil level problems. One p.s.i. of differential pressure is approximately equal to the head pressure of a 30" oil column. Thus, a relatively small pressure differential in the oil sumps, e.g. 0.25 p.s.i., may force a substantial quantity of oil out of a compressor with a higher sump pressure, possibly flooding a compressor with lower sump pressure.

In attempting to solve the lubricant distribution problem in parallel connected compressors, valves have been added to the oil level equalizing line to control oil flow between the oil sumps. For example, U.S. Pat. No. 2,294,552 discloses a float valve disposed in an oil equalizing line, and in a second embodiment, further discloses a valve actuated by differential pressure between the crankcases of the interconnected compressors. Both embodiments allow oil to flow between the crankcases of two compressors until a level in one reaches a minimum safe level, at which point, the valve closes to prevent any further lubricant flow and to prevent refrigerant fluid from flowing through the oil equalizing line.

One drawback of the lubricant handling scheme of the U.S. Pat. No. 2,294,552 patent is that the oil level in each of the two connected compressors varies between a minimum level and a maximum level that exceeds the "normal" level by an amount equal to the difference between the normal and the minimum levels. If three compressors were connected in parallel using this approach, the oil level in any one of the compressors might vary from a minimum level, to a maximum level that is a two times this difference above normal level. This would require an excessively large oil sump in each compressor to accommodate the volumetric changes in the lubricant level while providing adequate lubrication under all operating conditions. Clearly, the above noted scheme is not well suited for use on a system having more than two compressors connected in parallel. In addition, it is not well suited to an application wherein compressors of substantially different size are selectively operated in a parallel system, because the smaller compressor oil sump might not be capable of holding all the oil received from the larger compressor.

In consideration of the problems noted above, it is an object of the present invention to maintain adequate lubricant levels in the oil sumps of a plurality of parallel connected compressors.

A further object of the invention is to prevent fluid flow through an inactive compressor.

Yet a further object is to isolate a compressor that is inactive from the system suction and discharge manifolds.

Still a further object of the invention is to equalize pressure and oil levels in the oil sumps of the compressors while avoiding flow of suction gas through the oil sump of any inactive compressor.

These and other objects of the invention will be apparent from reference to the attached drawings and the description of the preferred embodiment that follows hereinbelow.

SUMMARY OF THE INVENTION

In a system having a plurality of parallel connected compressors, a method and apparatus are disclosed for isolating from common system suction and discharge lines, one of the compressors that is inactive. The apparatus includes a check valve disposed in a discharge line which connects a discharge port on the compressor to the system discharge line. This check valve is oriented to permit fluid flow out of the discharge port of the compressor, while preventing fluid flow in the opposite direction.

Valve means that are disposed in a suction line connected to a suction port on the compressor are in fluid communication with the compressor's discharge line at a point upstream of the check valve, i.e. between the check valve and the discharge port. When the compressor is inactive, the valve means are operative to close, stopping fluid flow into or out of the compressor suction port. However, in response to the pressure of compressed fluid in the compressor discharge line when the compressor is operating, the valve means open to enable fluid to flow into the suction port.

The valve means comprise a passage having a first and a second port in fluid communication with the system suction line and with the suction port on the compressor, respectively. In addition, the valve means include a cylinder having a third fluid port in fluid communication with the discharge port of the compressor. A piston is disposed in the cylinder and is biased by a spring to block fluid flow through the passage between the first and second ports. The piston is biased in the opposite direction, to open the passage to fluid flow, by the pressure of fluid introduced into the cylinder through the third fluid port.

Oil and sump pressure equalizing lines interconnect the oil sumps of the compressors to enable oil flow between the sumps and to equalize their pressure, respectively.

The valve means and check valve isolate the compressor from the system suction and discharge lines, while the equalizing lines provide dual paths for oil flow and pressure equalization. If each compressor is provided with a check valve, valve means, and equalizing lines connected in the same manner as the compressor already described, any one or more of the compressors may be de-energized without causing an imbalance in lubricant level in the oil sumps of the compressors in the system, or bypass of suction gas through the inactive compressor.

DESCRIPTION OF THE PREFERRED EMBODIMENT

Figure 1:
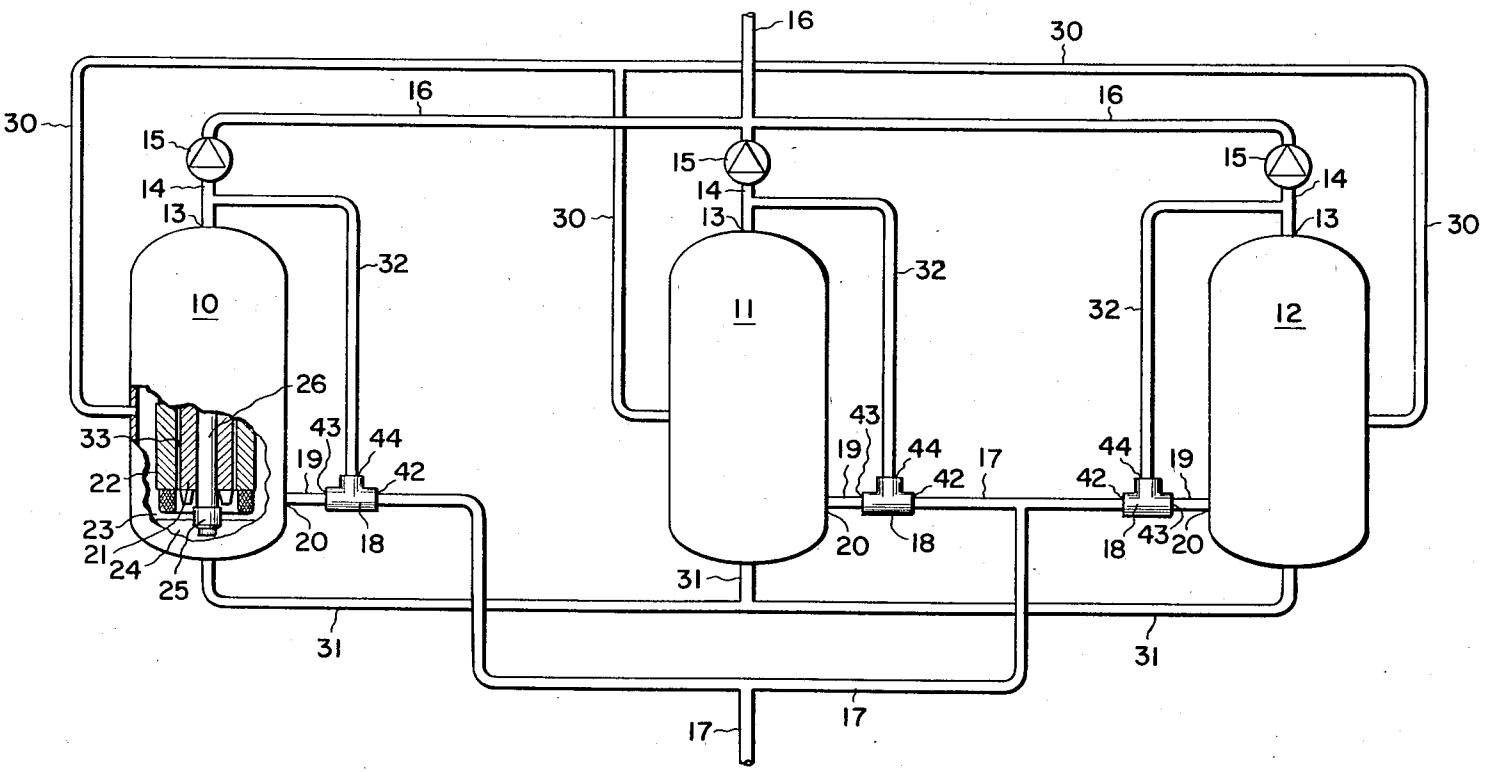
FIG. 1 shows three compressors connected in parallel to system suction and discharge fluid manifolds incorporating the subject invention.

With reference to FIG. 1, three refrigerant compressors denoted by reference numerals 10, 11, and 12 are shown interconnected by a manifold arrangement incorporating the subject invention. Each of compressors 10 through 12 are connected in parallel and are generally equivalent in operation and internal structure. For purposes of this disclosure, elements of the manifold connecting the compressors in the system are designated with the same reference numerals to indicate equivalent form and function of operation. It should be understoood that compressors 10 through 12 are mounted on a common horizontal plane such that none of the compressors is higher in elevation than any of the others. The importance of this will be apparent from the following description.

Any one of compressors 10 through 12 may be selectively energized as necessary to meet a temperature conditioning load imposed on the system. Thus, compressor 10 may be energized by itself, or in combination with either or both of compressors 11 and 12. Likewise, either of compressors 11 or 12 may be energized while the other two compressors are inactive. When energized, compressors 10 through 12 operate to compress a refrigerant fluid using a rotary or reciprocating compression mechanism (not shown). The compressed fluid exits the compressor shell through a discharge port 13, flows through a discharge line 14 and out through a check valve 15 into system discharge manifold 16. Check valves 15 are mounted to permit flow in the above described direction, while preventing flow in the reverse direction, i.e. from discharge manifold 16 back into discharge port 13. The system discharge lines 16 convey the compressed refrigerant fluid to heat exchangers (not shown) incorporated in the system which are operative to condense the compressed refrigerant fluid to a liquid, and to vaporize the liquid as it passes through an expansion device (also not shown) to expand in heat transfer with another fluid used for cooling a space. Vaporized refrigerant returns through system suction lines 17, passes through suction line valves 18, and flows through lines 19 into suction port 20 of any active compressor 10 through 12.

The cutaway view of compressor 10 in FIG. 1, discloses the lower portion of the internal components comprising each of compressors 10 through 12. Suction gas flowing through suction port 20 is channeled upward through the annulus 33 between rotor 21 and stator 22 of the electric motor used to drive compressor 10. This suction gas provides a cooling effect to the motor as it flows upward through the motor windings.

The lower portion of the compressor shell defines an oil sump 23 which holds a quantity or pool of lubricating oil 24. An oil pump 25 connected to the lower portion of drive shaft 26 depends into and is submerged within lubricant pool 24. During operation of the compressor, centrifugal force causes oil to flow upward through a vertical lubricant channel (not shown) formed in drive shaft 26 to the bearings and other moving surfaces of the compressor/motor assembly which require lubrication. This method of lubricating compressors and other rotating machinery is well known to those skilled in the art and need only be described in general terms. Those skilled in the art will likewise understand the need for adequate lubricant level in oil sump 23. If the level of the lubricant pool 24 in oil sump 23 should fall below the lower part of oil pump 25, oil will not flow to the surfaces requiring lubrication in the compressor when it operates, and the result may be excessive wear or even early failure of the compressor. Likewise, excess oil may flood the compressor, retarding its operation and possibly also resulting in its failure.

Each of compressors 10, 11, and 12 include a similar internal oil sump and mechanism for distributing oil to the moving parts of the compressors. Likewise, each compressor can be damaged by insufficient or excessive oil being present in oil sump 23 during operation of the compressor.

The oil sumps 23, of each of compressors 10 through 12, are interconnected by pressure equalizing lines 30, the ends thereof being connected to the compressors at an elevation well above the level of lubricating oil 24 in oil sumps 23. In addition, oil level equalizing lines 31 connect each of the oil sumps 23 of compressors 10 through 12 at a point near the bottom of the oil sump of each compressor.

Assuming that the pressure in oil sump 23 acting on the lubricating oil pooled therein is equal in each of compressors 10 through 12 and that they are mounted at the same elevation, lubricating oil should flow through oil equalizing lines 31 to maintain a relatively equal level of oil 24 in each of the three compressors. The subject invention acts to insure that approximately equal pressure exists in each of the oil sumps 23 of compressors 10 through 12 to effect this result.

Suction line valves 18 play an important role in achieving equal oil sump pressure for all the compressors. Valves 18 operate in combination with check valves 15 to isolate any compressor which is inactive from system suction manifold 17 and system discharge manifold 16. Suction line valves 18 close whenever the compressor with which they are associated is not operating to compress refrigerant fluid. Valves 18 are made responsive to the operating condition of their associated compressor by means of discharge pressure conveyed to the valves from lines 14 by means of lines 32. When one of the compressors 10 through 12 begins to operate to compress refrigerant fluid, its output or discharge pressure, as present in line 32, causes valve 18 of that compressor to open, allowing suction gas to flow from the suction manifold 17 into the compressor suction port 20 of that compressor, through line 19. When the compressor ceases to operate, the pressure in line 32 drops to a level which permits valve 18 to close, stopping both the flow of suction gas from manifold 17 into port 20 of that compressor and any fluid flow out of port 20 in the reverse direction. Check valve 15 isolates the discharge port 13 of any inactive compressor from the system discharge manifold 16, as already explained.

Figure 2:
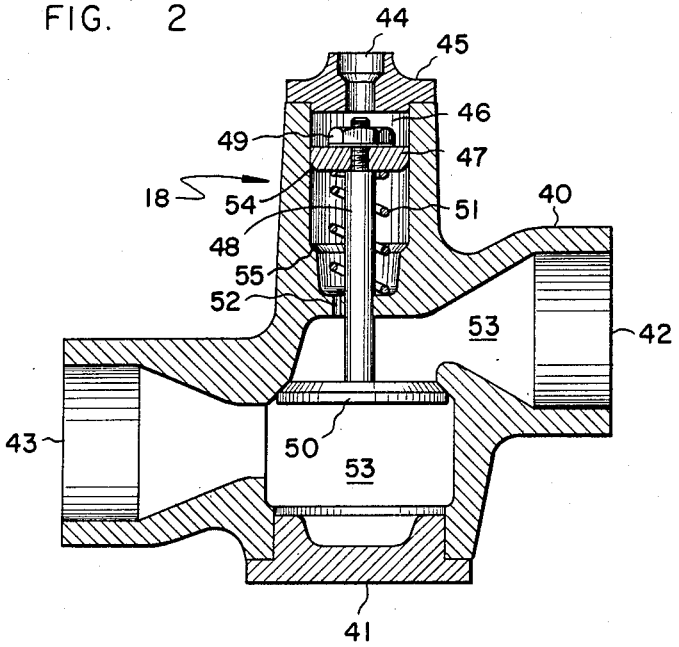
FIG. 2 shows a cutaway view of a first embodiment of a valve used to isolate a compressor from the system suction gas manifold when the compressor is inactive.

Turning now to FIG. 2, a first embodiment of valve 18 is shown which comprises a valve body casting 40 having a valve plug 41 disposed in its lower portion, an inlet 42, and an outlet 43. Casting 40 includes a flow-through passage 53 connecting inlet 42 in fluid communication with outlet 43 when valve 18 is "open". When the valve is installed in the system, inlet 42 is connected to system suction manifold 17, and outlet 43 to suction line 19.

An actuator port 44 is provided in the center of a top plug 45 which is fitted to seal the upper part of casting 40. Port 44 is connected to discharge pressure line 32. Actuator port 44 is in fluid communication with a chamber 46 defined by plug 45, casting 40 and the upper surface of a piston 47. Piston 47 is secured on a threaded end of valve stem 48 by means of nut 49. Valve stem 48 extends down into the central portion of casting 40 and is connected to a valve closure piston 50. A coiled helical spring 51 is disposed concentric to valve stem 48, between piston 47 and an intermediate portion of casting 40. Spring 51 acts against the undersurface of piston 47 to force valve closure piston 50 upward in sealing relationship with casting 40, to close off flow through passage 53 between inlet 42 and outlet 43 of valve 18. When fluid at discharge pressure is introduced through line 32 into the actuator port 44 of valve 18, the pressure of the fluid in chamber 46 overcomes the force of spring 51, forcing valve closure piston 50 downward, thereby opening passage 53 through casting 40 between inlet 42 and outlet 43. The force of the discharge pressure acting on piston 47 in valve 18 thus allows suction gas to flow through valve 18 into its associated compressor. When that compressor ceases operation, the force due to fluid pressure in chamber 46 falls to a level below the force exerted by spring 51, resulting in closure of passage 53 through valve 18, blocking fluid flow both in and out suction port 20 of the compressor associated with valve 18, relative to system suction manifold 17.

A bleed port 52 is provided through casting 40 to permit any discharge fluid which has leaked past piston 47 to return to suction regardless of whether valve 18 is open or closed. The pressure of such fluid on the side of piston 47 on which spring 51 acts thus does not inhibit the operation of valve 18 when it opens in response to pressure of discharge fluid introduced through actuator port 44. Leakage of discharge fluid past piston 47 from chamber 46 is minimized when valve 18 is fully open because piston 47 is beveled at edge 54 to seal against secondary seat 55.

Figure 3:
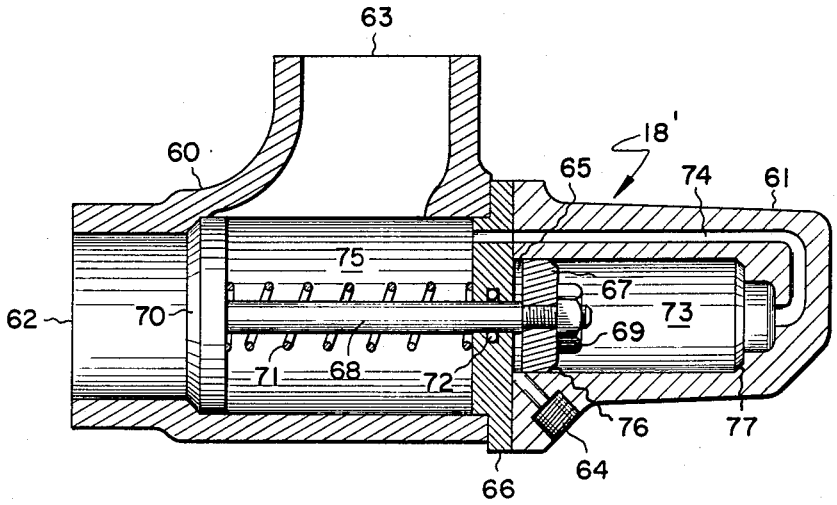
FIG. 3 shows a cutaway view of a second embodiment of the valve of FIG. 2.

Another embodiment of the suction line valve element of the invention is valve 18' shown in FIG. 3. This embodiment includes a casting comprising valve body 60 attached to an actuator body 61. Valve body 60 defines an inlet 62 and an outlet 63 to permit fluid flow through passage 75 of valve 18' when the valve is "open". Actuator body 61 includes an actuator port 64 in fluid communication with discharge actuator lines 32. Although not shown specifically in FIG. 1, valve 18' would be connected to the suction manifold, with inlet 62 being attached to the system suction manifold 17, and outlet 63 attached to compressor suction line 19. Compressor discharge fluid introduced by means of line 32 would flow through actuator port 64 into chamber 65, forcing a piston 67 that is connected to a valve stem 68 by means of a nut 69, to move to the right ("right/left" relative to the view of FIG. 3). This movement of piston 67 opens valve 18' by drawing valve closure piston 70 away from its seated position in valve body 60, permitting suction gas to flow from inlet 62 through valve body passage 75 to outlet 63.

Once its associated compressor ceases operation, the decrease in discharge pressure introduced through actuator port 64 permits helical spring 71 that is concentrically disposed around valve stem 68 to force valve closure piston 70 toward the left, seating it against valve body 60, thereby closing off fluid flow through passage 75 of valve 18'. An "O" ring 72 minimizes leakage from chamber 65 along valve stem 68. Leakage of discharge fluid past piston 67 into chamber 73 is avoided when valve 18' is fully open because bevel 76 on the piston seals against seat 77. Any discharge fluid leaking past piston 67 into chamber 73 is conveyed through bleed line 74 to suction, preventing a buildup of fluid pressure in chamber 73 that would otherwise inhibit the motion of piston 67.

Although two embodiments of the suction line valve 18 and 18' are disclosed herein, those skilled in the art will recognize that numerous other designs for pressure actuated valves could be used in this application to control the flow of fluid between one of the compressors 10 through 12 and suction manifold 17 when that compressor is inactive. Such valves, as illustrated by the disclosure of valves 18 and 18', are relatively simple in construction and in operation.

It may seem that valves 18 or 18' are not needed to block the flow of fluid from a non-operating compressor into suction manifold 17, since oil sump pressure equalizing lines 30 are operative to convey fluid between each of the compressors regardless of their operating condition. As noted above, it is critical that the pressure applied to the lubricant pool 24 in each of compressors 10 through 12 be substantially equal to maintain an equal level of oil in sump 23 of each of the compressors. If valves 18 (or 18') and equalizing lines 30 were not provided, the oil level in any inactive compressor would fall substantially, while rising in any compressors which continued to operate, due to the pressure differential developed between the oil sumps of the operating and inactive compressors. Due to the pressure drop of the refrigerant fluid flowing into the operating compressors, e.g. the pressure drop incurred as refrigerant fluid flows to an operating compressor through manifold lines 17, the pressure in oil sump 23 of each of the operating compressors would be lower than in each of the inactive compressors. The higher pressure in oil sump 23 of an inactive compressor would force oil through oil equalizing lines 31 into the operating compressor oil sumps 23.

If oil sump pressure equalizing lines 30 are provided but valves 18 (or 18') are not, the problem of unequal sump pressures and oil levels may continue to exist due to refrigerant flow from the suction manifold for the system through any inactive compressor and the oil sump pressure equalizing line into each of the operating compressors. In addition, it is not desirable to have refrigerant flow through an inactive compressor since the refrigerant may condense inside the inactive compressor shell rather than being conveyed to the operating compressor(s). Further, refrigerant flow through an inactive compressor would reduce the cooling provided by refrigerant fluid flow through the motors in each operating compressor. The addition of valves 18 (or 18'), as in the embodiment of the invention hereinabove described, prevents this problem.

It will be apparent that a solenoid version of valve 18 could be used which would be activated electrically to open whenever its associated compressor were energized to compress refrigerant fluid; however, the cost and complexity of a solenoid valve of the size required for use on a suction line would be relatively great compared to a pressure actuated valve. For these and other reasons, the simple mechanical valve 18 and 18' as disclosed hereinabove are considered preferable.

The present invention is also applicable to a heat pump system, wherein lines 16 and 17 would be connected to a reversing valve. Other modifications to the invention will occur to those skilled in the art within the scope of the claims which follow hereinbelow. The invention is in no way intended to be limited by the disclosure of the preferred embodiments since various other modifications and additions may be made thereto without departing from the spirit and scope of the invention as defined in these claims.

I claim:

1. In a fluid compression system including a plurality of hermetic shell compressors connected in parallel to a system discharge line and a system suction line, apparatus for isolating one of the compressors that is inactive from the discharg and suction lines, comprising:

(a) a check valve disposed in a separate discharge line conveying compressed fluid from said one compressor to the system discharge line, said check valve oriented so as permit compressed fluid to flow into the system discharge line from a discharge port disposed in the hermetic shell of said one compressor when it is operating to compress fluid, and to prevent fluid flow in the opposite direction;

(b) a suction valve that opens in response to pressure in said separate discharge line and connected in fluid communication with both a suction port disposed in the hermetic shell of said one compressor and the system suction line for closing off fluid flow between the system suction line and the suction port when said one compressor is inactive, and for permitting fluid flow into the suction port from the system suction line when said one compressor is operating to compressor fluid;

(c) an oil sump disposed in each of the hermetic shell compressors for containing lubricating oil;

(d) an oil equalizing line interconnecting the oil sumps to enable oil to flow therebetween; and (e) at least one sump pressure equalizing line interconnecting the oil sumps at an elevation above that at which the oil equalizing lines connect to the oil sumps, said sump pressure lines being operative to equalize sump pressure in the oil sumps of the interconnected compressors.

2. The apparatus of claim 1 wherein the valve means comprise:

a piston; and a passage having:

(i) a first and a second port in fluid communication with the system suction line and with the suction port of said one compressor, respectively, and (ii) a cylinder having a third fluid port in fluid communication with the discharge port of said one compressor, upstream of said check valve.

3. The apparatus of claim 2 wherein said valve means further comprise a spring that acts on the piston in opposition to a force created by the pressure of fluid introduced into said cylinder through the third fluid port, said spring acting on the piston to displace it so as to block fluid flow through the passage between the first and second ports.

4. The apparatus of claim 1 further comprising a check valve and valve means connected respectively to each of a plurality of compressors in the system in the same manner as for said one compressor, so that each of said compressors that is inactive, is isolated from the system suction and discharge lines.

5. In a fluid compression system including a plurality of compressor connected in parallel, a suction and discharge line manifold comprising:

a discharge line connecting a discharge port on each compressor in fluid communication with a system discharge line;

a check valve disposed in the discharge line of one compressor and oriented so as to permit fluid flow out of the discharge port into the common discharge line when said one compressor is operating to compress fluid, and to block fluid flow in the opposite direction;

a suction line connected in fluid communication with a suction port on said one compressor and with the system suction line;

a suction line valve disposed in the suction line of said one compressor, said suction line valve including a spring that normally biases the valve closed to shut off fluid flow through the suction line into the suction port of said one compressor and a pressure actuated piston that opens the suction valve in response to pressure in the discharge port of said one compressor to permit fluid flow through the suction line into the suction port; and a discharge pressure actuator line connecting the discharge line of said one compressor at a point between the discharge port of said one compressor and said check valve, in fluid communication with the suction line valve, said actuator line being operative to convey fluid at discharge pressure to the suction line valve to act on the piston causing it to open the suction line valve when said compressor is operating, such that said check valve and said suction line valve operate together to isolate said one compressor from the system suction and discharge lines when said compressor is inactive, but otherwise are operative to permit fluid flow into the suction port and out the discharge port of said one compressor when it is operating to compress fluid.

6. The manifold of claim 5 wherein each compressor in the system includes an oil sump containing lubricating oil and wherein oil equalizing lines interconnect a plurality of the oil sumps in fluid communication in order to equalize the depth of oil in the oil sumps of the interconnected compressors.

7. The manifold of claim 6 wherein sump pressure equalizing lines interconnect said plurality of oil sumps at an elevational level substantially above that at which the oil equalizing lines connect to the oil sumps, said sump pressure lines being operative to equalize fluid sump pressure in the oil sumps of the interconnected compressors.

8. The manifold of claim 6 further comprising a check valve in the discharge line, a discharge pressure actuator line, and a suction line valve connected to the suction port for each of one or more other of the plurality of compressors in the system, so that each of said other compressors may be isolated from the system suction and discharge lines when inactive, in the same manner as said one compressor.

9. The manifold of claim 8 wherein the plurality of compressors are each enclosed within a hermetic shell and wherein the oil sump of each compressor is disposed in the lower portion of the hermetic shell.

* * * * *